US007845336B2

(12) United States Patent
Burkitt et al.

(10) Patent No.: US 7,845,336 B2
(45) Date of Patent: Dec. 7, 2010

(54) FUEL DELIVERY SYSTEM HAVING ELECTRIC PUMP

(75) Inventors: Joseph Shane Burkitt, Edwards, IL (US); Ye Tian, Bloomington, IL (US); Drew Christopher Donnelli, Edwards, IL (US)

(73) Assignee: Caterpillar Inc, Peoria, IL (US)

( * ) Notice: Subject to any disclaimer, the term of this patent is extended or adjusted under 35 U.S.C. 154(b) by 70 days.

(21) Appl. No.: 12/314,875

(22) Filed: Dec. 18, 2008

(65) Prior Publication Data

US 2010/0154752 A1 Jun. 24, 2010

(51) Int. Cl.
*F01N 3/00* (2006.01)

(52) U.S. Cl. ..... 123/445; 123/446; 60/295; 60/303

(58) Field of Classification Search ..... 123/445, 123/446, 447, 495; 60/274, 286, 300, 303, 60/295; 417/286
See application file for complete search history.

(56) References Cited

U.S. PATENT DOCUMENTS

| | | | | |
|---|---|---|---|---|
| 3,750,401 | A | 8/1973 | Nambu | |
| 3,827,237 | A * | 8/1974 | Linder et al. | 60/274 |
| 3,827,238 | A | 8/1974 | Hayashi | |
| 3,981,288 | A * | 9/1976 | Wessel | 123/482 |
| 4,393,825 | A * | 7/1983 | Breeck et al. | 123/198 F |
| 4,467,627 | A * | 8/1984 | Platt et al. | 68/17 R |
| 4,567,725 | A | 2/1986 | Shinzawa et al. | |
| 4,672,808 | A | 6/1987 | Leonhard et al. | |
| 4,930,994 | A * | 6/1990 | Budecker | 417/286 |
| 4,991,396 | A | 2/1991 | Goerlich et al. | |
| 5,189,876 | A | 3/1993 | Hirota et al. | |
| 5,357,908 | A | 10/1994 | Sung et al. | |
| 5,435,130 | A * | 7/1995 | Kroiss et al. | 60/300 |
| 5,456,079 | A | 10/1995 | Langen | |
| 5,842,341 | A | 12/1998 | Kibe | |
| 6,834,496 | B2 * | 12/2004 | Nakatani et al. | 60/274 |
| 6,865,879 | B2 | 3/2005 | Posselt et al. | |
| 6,922,988 | B2 * | 8/2005 | Yamaguchi et al. | 60/286 |
| 6,938,409 | B2 | 9/2005 | Birckigt et al. | |
| 7,316,545 | B2 | 1/2008 | Lenke | |
| 2006/0277899 | A1 | 12/2006 | Ruona | |
| 2008/0053069 | A1 * | 3/2008 | Cox et al. | 60/285 |
| 2008/0209895 | A1 * | 9/2008 | Miller et al. | 60/295 |
| 2008/0245058 | A1 * | 10/2008 | Boddy et al. | 60/286 |
| 2009/0025685 | A1 * | 1/2009 | Einberger et al. | 123/447 |

* cited by examiner

*Primary Examiner*—Thomas N Moulis
(74) *Attorney, Agent, or Firm*—Finnegan, Henderson, Farabow, Garrett & Dunner LLP; Carl E. Myers

(57) ABSTRACT

A fuel delivery system is provided for a combustion engine having an exhaust treatment device. The fuel delivery system includes a fuel supply, an injector configured to pressurize fuel and inject the pressurized fuel into the combustion engine, and a transfer pump configured to direct fuel from the fuel supply to the injector. The fuel delivery system also includes an electric pump configured to selectively direct fuel from the fuel supply to the injector during a priming event, and to selectively direct fuel from the fuel supply to the exhaust treatment device.

18 Claims, 6 Drawing Sheets

FUEL DELIVERY SYSTEM HAVING ELECTRIC PUMP

TECHNICAL FIELD

The present disclosure is directed to a fuel delivery system and, more particularly, to a fuel delivery system having an electric pump.

BACKGROUND

Operation of an internal combustion engine, for example a diesel, gasoline, or gaseous fuel-powered engine, requires fuel to be supplied to one or more cylinders of the engine and combusted therein to produce power. To ensure efficient engine operation, it is desired that the fuel is supplied to the engine with a predetermined pressure and flow rate.

Combustion of the fuel can generate undesirable emissions. These emissions, which may include particulates, oxides of nitrogen (NOx), and/or oxides of sulfur (SOx), are exhausted to the environment if no emission reduction measures are in place. Many different approaches, such as exhaust aftertreatments, have been developed to reduce the amount of emissions discharged during operation of an engine. Exhaust treatment devices, such as diesel particulate filters and NOx and/or SOx reducing devices, have been used in some exhaust aftertreatment systems.

Some exhaust treatment devices require a fuel supply during normal operations and/or during regeneration events. For example, in some applications, fuel is injected into the exhaust as a reductant for reducing exhaust constituents, such as NOx and/or SOx. In some applications, fuel is supplied to a fuel-fired burner associated with a diesel particulate filter or catalyst and burned in the fuel-fired burner to provide a sufficient temperature for promoting regeneration of the diesel particulate filter or operation of the catalyst.

In addition, in many engine applications, fuel priming is desired before the engine is started for full combustion. Typically, a fuel flow of a predetermined pressure and flow rate is delivered to the engine during a priming event, which may be conducted when the engine is turned off or during a cracking stage at low speeds.

Therefore, a power system that includes an internal combustion engine and an exhaust aftertreatment system may require different fuel flows for different events, such as the engine combustion event, the exhaust aftertreatment event, and the priming event. The pressure and flow rate requirements for these events may also be different.

A fuel system that includes a pump for delivering fuel to multiple devices of an engine system is described in U.S. Patent Application Publication No. 2006/0277899 A1 (the '899 publication) to Ruona published on Dec. 14, 2006. In particular, the '899 publication discloses a fuel system having a mechanical vane transfer and priming pump. The mechanical vane transfer and priming pump delivers fuel to an engine for both combustion and priming, and to an exhaust aftertreatment device for treating exhaust.

While the fuel system of the '899 publication may reduce the complexity of the fuel system by using a single pump for multiple purposes, the fuel system may be problematic. Because the requirements for fuel pressures and flow rates can be different for engine combustion, fuel priming, and exhaust aftertreatment events, the operating conditions (i.e., pressure and flow rate) of the mechanical vane transfer and priming pump may need to be frequently switched between different states (i.e., different pressures and flow rates), which may adversely impact the health of the pump and result in early failure of the pump. Furthermore, the frequent changing of the pump's operating conditions may adversely affect fuel delivery to the engine, thereby reducing engine operation efficiency.

The fuel delivery system of the present disclosure is directed toward improvements in the existing technology.

SUMMARY

One aspect of the present disclosure is directed to a fuel delivery system for a combustion engine having an exhaust treatment device. The fuel delivery system includes a fuel supply, an injector configured to pressurize fuel and inject the pressurized fuel into the combustion engine, and a transfer pump configured to direct fuel from the fuel supply to the injector. The fuel delivery system also includes an electric pump configured to selectively direct fuel from the fuel supply to the injector during a priming event, and to selectively direct fuel from the fuel supply to the exhaust treatment device.

Another aspect of the present disclosure is directed to a fuel delivery system for a combustion engine having an exhaust treatment device. The fuel delivery system includes a fuel supply, a common rail, and a high-pressure pump configured to pressurize fuel directed to the common rail. The fuel delivery system also includes an injector configured to inject pressurized fuel from the common rail into the combustion engine, and a fuel transfer pump configured to direct fuel from the fuel supply to the high-pressure pump. The fuel delivery system further includes an electric pump configured to selectively direct fuel from the fuel supply to the combustion engine during a priming event, and to selectively direct fuel from the fuel supply to the exhaust treatment device.

Another aspect of the present disclosure is directed to a method of providing fuel to a power system including a combustion engine. The method includes transferring the fuel from a fuel supply to a first location. The method also includes pressurizing the fuel at the first location. The method also includes directing the fuel from the first location into the combustion engine. The method also includes pressurizing the fuel at a second location. The method further includes selectively directing the fuel from the second location into the combustion engine, and selectively directing the fuel from the second location into exhaust from the combustion engine.

Another aspect of the present disclosure is directed to an electric pump. The electric pump includes an inlet, a first outlet, and a second outlet. The electric pump also includes a pumping element configured to pressurize fluid received via the inlet. The electric pump further includes a valve configured to selectively direct fluid pressurized by the pumping element to at least one of the first outlet and the second outlet.

DETAILED DESCRIPTION

Figure 1:
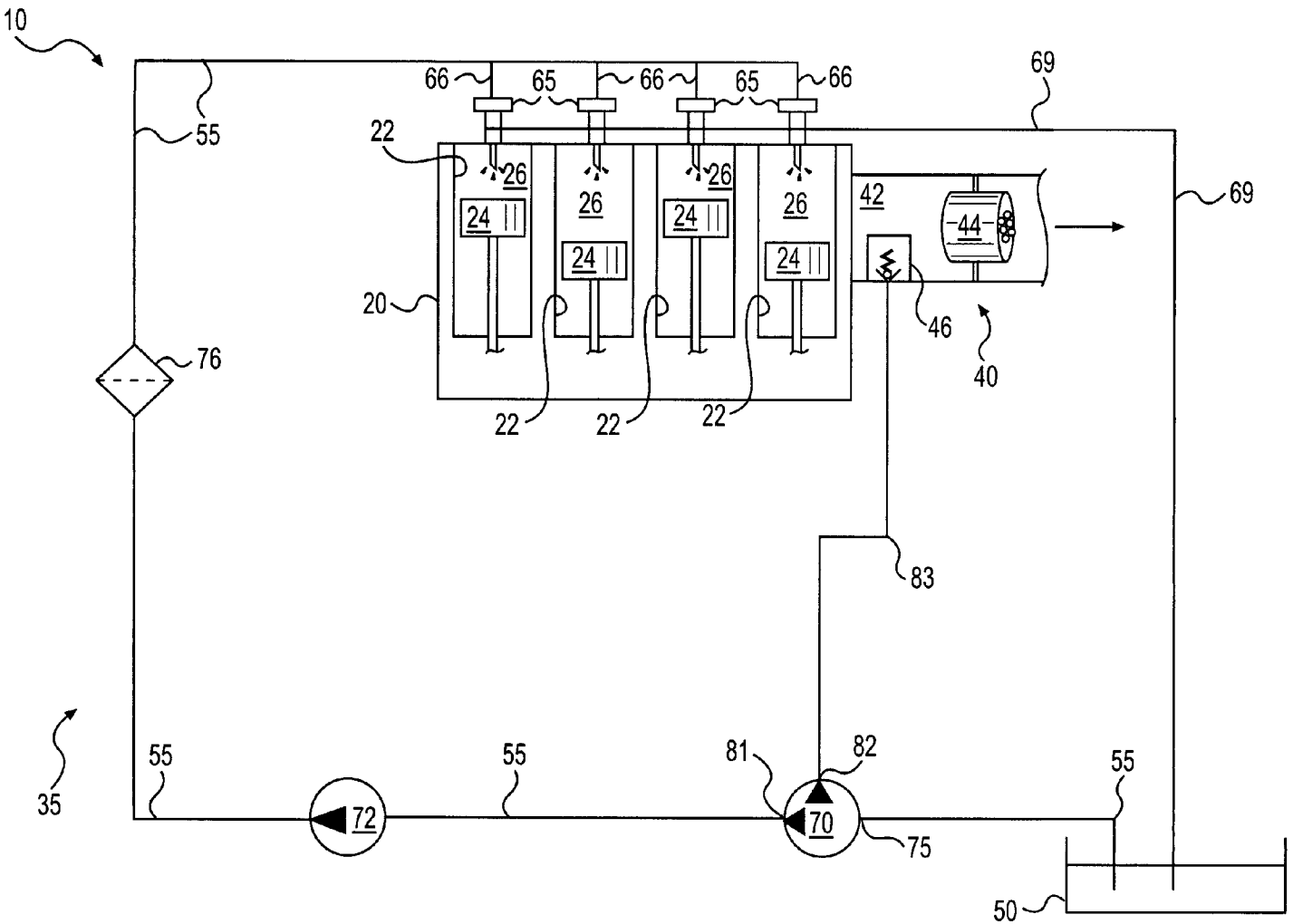
FIG. 1 is a schematic illustration of an exemplary disclosed power system.

An exemplary embodiment of a power system 10 is illustrated in FIG. 1. Power system 10 may include an internal combustion engine 20, a fuel delivery system 35, and an exhaust system 40. Combustion engine 20 may include one or more cylinders 22. For the purposes of this disclosure, combustion engine 20 is depicted and described as having four cylinders 22. One skilled in the art will recognize, however, that combustion engine 20 may include any suitable number of cylinders 22, and may be any type of combustion engine such as, for example, a gasoline, a diesel, or a gaseous fuel-powered engine.

Combustion engine 20 may also include a piston 24 slidably disposed within each cylinder 22. Each cylinder 22, together with each piston 24, may at least partially define a combustion chamber 26. One skilled in the art will readily recognize that combustion chamber 26 may be disposed in an "in-line" configuration, a "V" configuration, or in any other conventional configuration. Each piston 24 may be connected with a crankshaft (not shown) so as to reciprocate within combustion chamber 26.

Exhaust system 40 may include an exhaust passage 42 connected with combustion engine 20. It is contemplated that exhaust system 40 may include an exhaust manifold (not shown) in fluid communication with cylinders 22 to receive exhaust produced by combustion engine 20 and discharged from combustion chambers 26. The exhaust manifold may direct the exhaust to various devices of exhaust system 40 via exhaust passage 42.

Exhaust system 40 may include any number of exhaust treatment devices 44. Each exhaust treatment device 44 may be configured to treat the exhaust from combustion engine 20. For example, one exhaust treatment device 44 may be a diesel particulate filter configured to remove diesel particulate matter from the exhaust. A fuel injection device 46 may be associated with the diesel particulate filter and be configured to inject and/or burn fuel to promote regeneration of the diesel particulate filter. Fuel may be injected into the exhaust flow upstream of exhaust treatment device 44 during a regeneration event. Exhaust treatment device 44 may alternatively embody a catalyst substrate configured to reduce exhaust constituents, such as NOx and/or SOx from the exhaust in the presence of fuel. In some embodiments, fuel injection device 46 may also be integral with exhaust treatment device 44, if desired.

Fuel delivery system 35 may include a fuel supply 50, a fuel supply line 55, one or more fuel injectors 65, a fuel return line 69, and at least one pump. Fuel supply 50 may be configured to store an amount of fuel. Fuel supply line 55 may be disposed between fuel supply 50 and fuel injectors 65, and be configured to direct fuel from fuel supply 50 to fuel injectors 65. Fuel supply line 55 may direct fuel to fuel injectors 65 via individual fuel lines 66. Each fuel injector 65 may be at least partially disposed within each cylinder 22, and may be a unit type fuel injector configured to pressurize fuel and inject the pressurized fuel into each associated combustion chamber 26 of combustion engine 20. Fuel return line 69 may fluidly connect fuel injectors 65 to fuel supply 50, and may be configured to direct surplus fuel from fuel injectors 65 to fuel supply 50. It is contemplated that fuel return line 69 may include various components, such as a cooler, a check valve, a pressure regulator, etc.

Fuel delivery system 35 may also include an electric pump 70 and a transfer pump 72, each of which may be disposed in communication with fuel supply line 55. Electric pump 70 may be configured to selectively direct fuel from fuel supply 50 to fuel injectors 65 during a priming event, and to selectively direct fuel from fuel supply 50 to exhaust treatment device 44 during an exhaust aftertreatment event. Transfer pump 72 may be configured to transfer fuel from fuel supply 50 to fuel injectors 65 during normal operations of combustion engine 20 (i.e., during operations after a startup event has been completed). Transfer pump 72 may be any suitable mechanical, electrical, or hydraulic pump. For example, in one embodiment, transfer pump 72 may be a mechanical pump driven by combustion engine 20. Fuel delivery system 35 may also include a filter 76 configured to clean fuel. Filter 76 may be any type of suitable filter known in the art, and may be disposed at any suitable location within fuel supply line 55, for example, downstream of transfer pump 72. It is contemplated that fuel delivery system 35 may include other components known in the art within fuel supply line 55, such as pressure regulators and check valves, if desired.

Electric pump 70 may include at least one inlet 75 and at least one outlet. Inlet 75 may be in fluid communication with fuel supply 50 through fuel supply line 55. In the embodiment shown in FIG. 1, electric pump 70 includes a first outlet 81 and a second outlet 82. First outlet 81 may be fluidly connected with fuel supply line 55, and may be configured to direct a pressurized fuel flow generated by electric pump 70 to combustion engine 20 through fuel supply line 55. Second outlet 82 may be fluidly connected with fuel injection device 46 through a fuel line 83, and may be configured to direct a pressurized fuel flow generated by electric pump 70 to exhaust treatment device 44 through fuel line 83 and fuel injection device 46.

Figure 2:
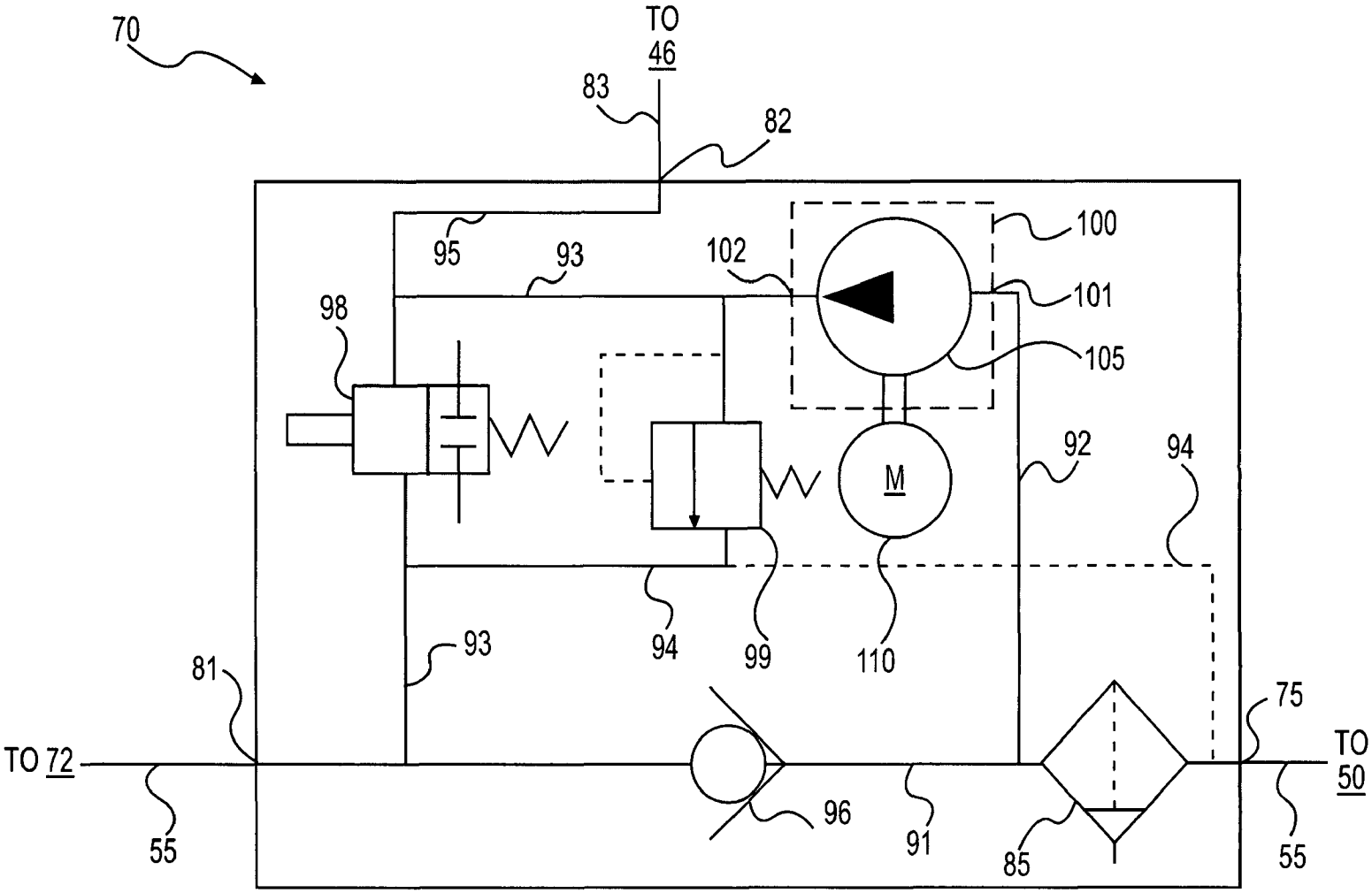
FIG. 2 is a schematic illustration of an exemplary disclosed electric pump associated with the power system of FIG. 1.

FIG. 2 schematically illustrates details of the disclosed exemplary electric pump 70 shown in FIG. 1. Electric pump 70 may include a first internal fuel passage 91 fluidly connecting inlet 75 to first outlet 81. Electric pump 70 may include a filter 85 disposed within first internal fuel passage 91. Filter 85 may be a fuel filter with a water separator, or any suitable filter known in the art. Filter 85 may be disposed within electric pump 70, as shown in FIG. 1, or may be disposed externally to electric pump 70, for example, within fuel supply line 55, if desired. A valve 96, for example a check valve, may be disposed within first internal fuel passage 91 to allow a unidirectional fuel flow from inlet 75 to first outlet 81. Valve 96 may alternatively be any other suitable type of valve known in the art.

Electric pump 70 may include a pumping chamber 100 and a pumping element 105 disposed within pumping chamber 100. Pumping chamber 100 may include an inlet 101 and an outlet 102. Electric pump 70 may include a second internal fuel passage 92 fluidly connecting first internal fuel passage 91 to inlet 101 of pumping chamber 100. Second internal fuel passage 92 may be configured to direct fuel from first internal fuel passage 91 to pumping chamber 100 through inlet 101.

Pumping element 105 may include any suitable structures, for example, a drive shaft (not shown) rotatably coupled with a plurality of vanes (not shown). Pumping element 105 may be driven by an electric motor 110, or any other suitable drive means. Pumping element 105 may draw fuel from fuel supply 50, pressurize the fuel within pumping chamber 100, and generate a fuel flow which may be directed to combustion engine 20 or exhaust treatment device 44. The pressurized fuel flow may be directed out of pumping chamber 100 through outlet 102.

Electric pump 70 may also include a third internal fuel passage 93 fluidly connecting outlet 102 of pumping chamber 100 to first internal fuel passage 91, for example, downstream of valve 96. A valve 98 may be disposed within third internal fuel passage 93 downstream of pumping element 105. Valve 98 may be a manually-controlled valve, which may be associated with a manual switch operable by an operator to open and close valve 98. Valve 98 may also be an electrically-controlled valve, for example, a solenoid valve or any other suitable type of valve. Valve 98 may be associated with a controller (not shown), for example, an existing engine control module or a stand-alone controller (not shown) dedicated to controlling valve 98. Valve 98 may be movable, for example, by the engine control module to allow or inhibit fuel flow within third internal fuel passage 93. In other words, valve 98 may selectively control fuel flows generated by pumping element 105 and directed to combustion engine 20 during, for example, a priming event.

Electric pump 70 may also include a pressure regulator 99 configured to regulate a pressure associated with pumping chamber 100. Pressure regulator 99 may be disposed within a fourth internal fuel passage 94 that may bypass valve 98. In one example, fourth internal fuel passage 94 may connect a portion of third internal fuel passage 93 immediately upstream of valve 98 to a portion of third internal fuel passage 93 immediately downstream of valve 98. In another example, fourth internal fuel passage 94 may connect a portion of third internal fuel passage 93 immediately upstream of valve 98 to first internal fuel passage 91, for example, upstream of filter 85.

Electric pump 70 may include a fifth internal fuel passage 95 connected to third internal fuel passage 93 between second outlet 82 and valve 98. Fifth internal fuel passage 95 may be configured to direct fuel from pumping chamber 100 to second outlet 82, which may be subsequently directed to exhaust treatment device 44 through fuel line 83.

Figure 3:
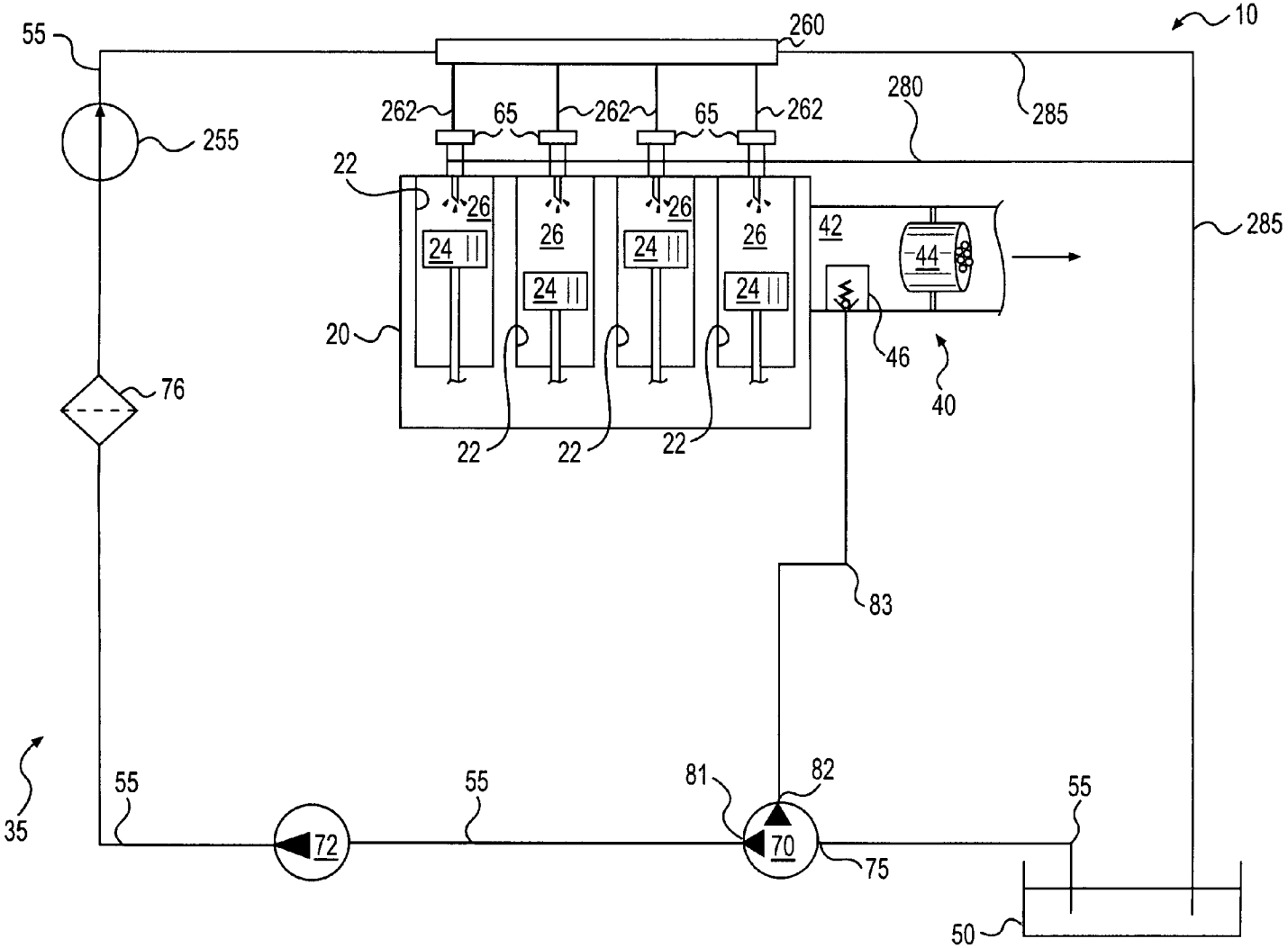
FIG. 3 is a schematic illustration of another exemplary disclosed power system.

As shown in FIG. 3, an alternative embodiment of power system 10 may further include a high-pressure pump 255 and a common rail 260. High-pressure pump 255 may be disposed within fuel supply line 55, for example, downstream of transfer pump 72 and upstream of common rail 260. High-pressure pump 255 may be configured to pressurize fuel received from transfer pump 72 to a predetermined level, and direct the high-pressure fuel to common rail 260.

In the fuel delivery system 35 shown in FIG. 3, common rail 260 may be fluidly connected with fuel injectors 65 through individual fuel lines 262. Common rail 260 may direct high-pressure fuel received from high-pressure pump 255 to fuel injectors 65. In this exemplary embodiment, fuel injectors 65 may be common rail type injectors that do not individually pressurize fuel. Fuel delivery system 35 may include a fuel return line 285 fluidly connecting common rail 260 to fuel supply 50, and a fuel line 280 fluidly connecting fuel injectors 65 to fuel supply 50 via fuel return line 285. Surplus fuel from common rail 260 may be redirected to fuel supply 50 through fuel return line 285. Surplus fuel from fuel injectors 65 may be redirected to fuel supply 50 through fuel line 280 and fuel return line 285. Electric pump 70 shown in FIG. 3 may have similar components as shown in FIG. 2.

Figure 4:
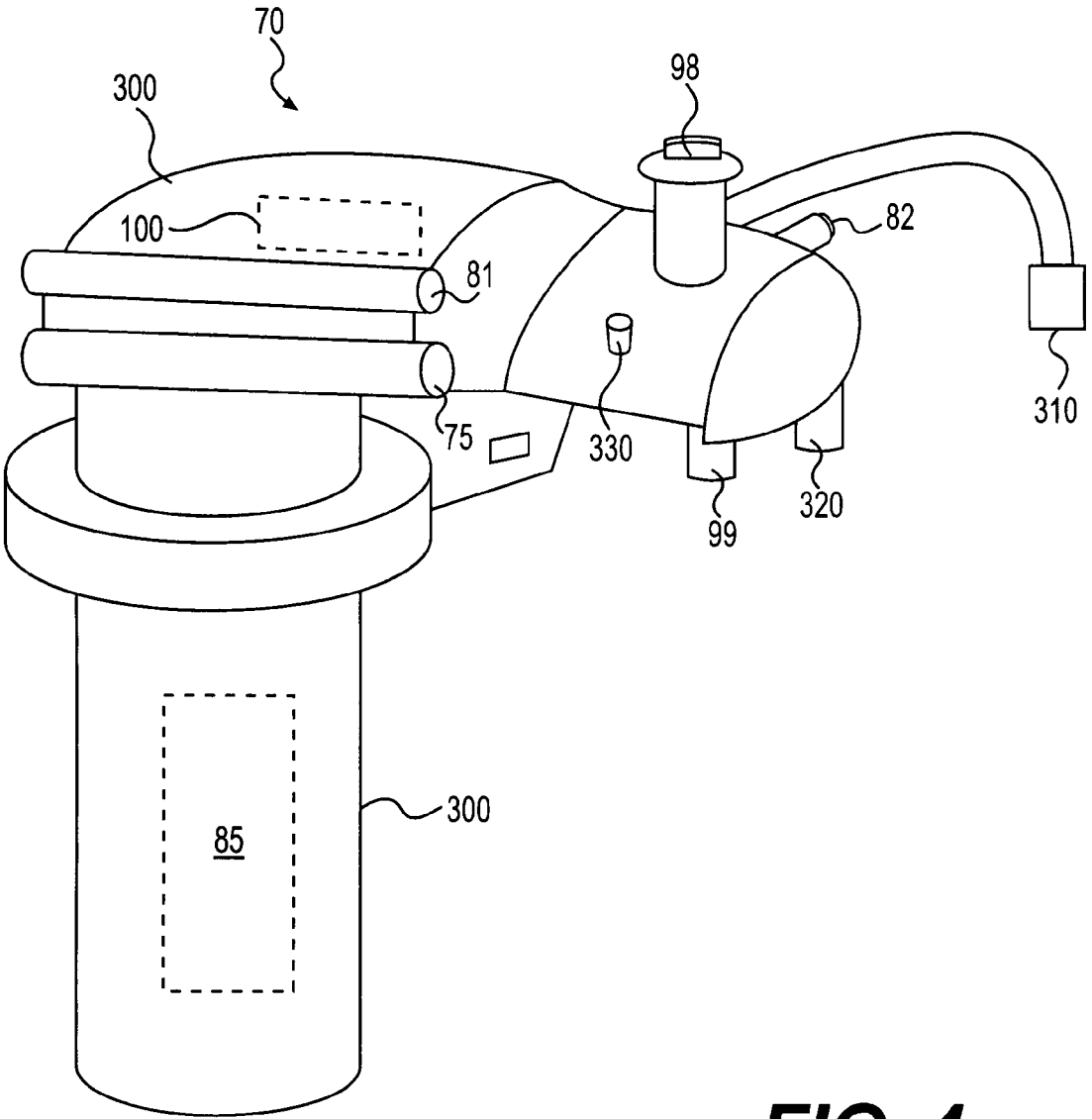
FIG. 4 is an isometric view of the exemplary electric pump of FIG. 2.

FIG. 4 provides an isometric view of electric pump 70 used in power system 10 of FIG. 2. As illustrated in FIG. 4, electric pump 70 may include a housing 300, with filter 85 being disposed within or connected to housing 300. Housing 300 may include inlet 75, first outlet 81, and second outlet 82. Pumping chamber 100 may be located within housing 300, as schematically illustrated in FIG. 4. Valve 98 and pressure regulator 99 may be disposed at any suitable locations of housing 300, and may be within housing 300, or fixed to an exterior surface of housing 300. Electric pump 70 may include a first power connection port 310 associated with housing 300. First power connection port 310 may be associated with electric motor 110 and/or valve 98, and may be connected to an external power source (not shown), such as a battery that provides power to electric motor 110 and/or valve 98. In one exemplary embodiment, electric pump 70 may include a second power connection port 320, which may be connected to the same power source that provides power to first power connection port 310, or to a separate power source. Electric pump 70 may also include a manual switch 330, which may be disposed at a suitable location of housing 300, for example, at least partially within housing 300, or fixed to an exterior surface of housing 300. Manual switch 330 may be associated with operation of valve 98 and/or electric motor 110. Manual switch 330 may be actuated by an operator to energize valve 98 and/or electric motor 110 during the priming event.

Figure 5:
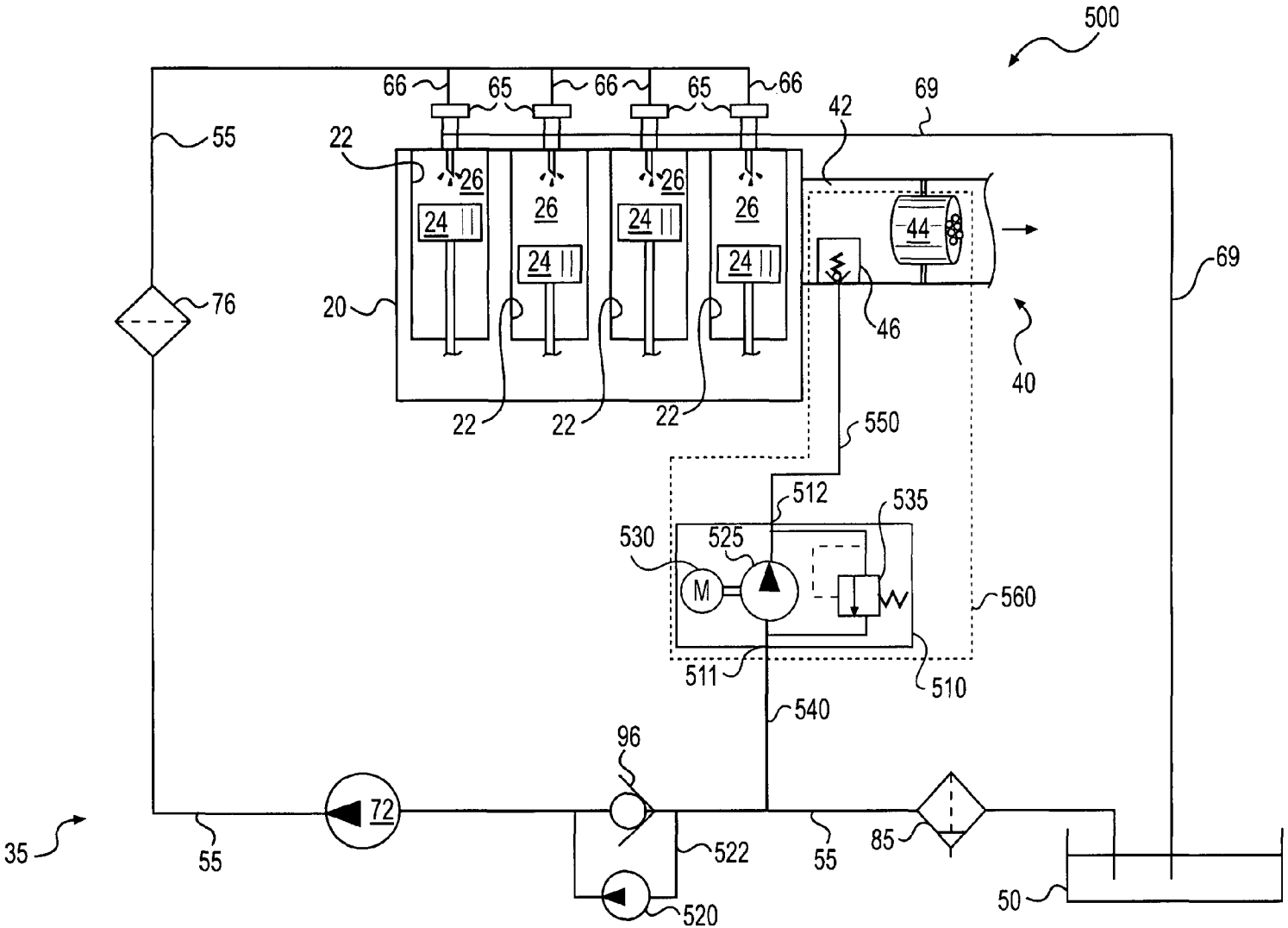
FIG. 5 is a schematic illustration of another exemplary disclosed power system.

FIG. 5 schematically illustrates another exemplary disclosed power system 500. In this embodiment, fuel delivery system 35 may include a first electric pump 510 configured to direct fuel from fuel supply 50 to exhaust treatment device 44 during an exhaust aftertreatment event. First electric pump 510 may be similar to electric pump 70, except that first electric pump 510 may be dedicated to directing fuel to only exhaust treatment device 44. That is, the fuel priming function may have been removed from first electric pump 510. First electric pump 510 may include an inlet 511, an outlet 512, and a pumping element 525 associated with an electric motor 530. Pumping element 525 may be driven by electric motor 530. Similar to electric pump 70, first electric pump 510 may include a housing and a pumping chamber located within the housing for accommodating pumping element 525. First electric pump 510 may also include a pressure regulator 535, which may be configured to regulate a pressure associated with the pumping chamber. First electric pump 510 may or may not include a filter therein. Filter 85 may be disposed within fuel supply line 55, external to first electric pump 510, as shown in FIG. 5.

A fuel line 540 may fluidly connect inlet 511 of first electric pump 510 to fuel supply line 55. First electric pump 510 may draw fuel from fuel supply line 55 through fuel line 540. A fuel line 550 may fluidly connect outlet 512 with fuel injection device 46 associated with exhaust treatment device 44. It is contemplated that one or more filters may be disposed within fuel line 540, external to first electric pump 510.

Because the priming function may have been removed from first electric pump 510, first electric pump 510 may be made relatively smaller than electric pump 70 shown in FIGS. 1-3. The reduced size of first electric pump 510 may enable it to be installed at a suitable location adjacent combustion engine 20, or within exhaust system 40. For example, first electric pump 510 may be installed at any suitable location of exhaust passage 42, for example, on exhaust passage 42, or at least partially within exhaust passage 42. In one embodiment, first electric pump 510 may be combined with fuel injection device 46 and exhaust treatment device 44 in a single unit 560, as shown in dashed lines.

Fuel delivery system 35 may also include a second electric pump 520 configured to direct fuel from fuel supply 50 to combustion engine 20 during a priming event. Second electric pump 520 may be disposed within a fuel line 522, which may be located in parallel with any suitable portion of fuel supply line 55. Second electric pump 520 may be disposed upstream of transfer pump 72. In one embodiment, second electric pump 520 may be disposed in parallel with valve 96 within fuel supply line 55. Alternatively, it is contemplated that fuel line 522 may directly connect fuel supply 50 to combustion engine 20, if desired. Second electric pump 520 may also be associated with a pressure regulator, an electric motor, and other components known in the art.

Figure 6:
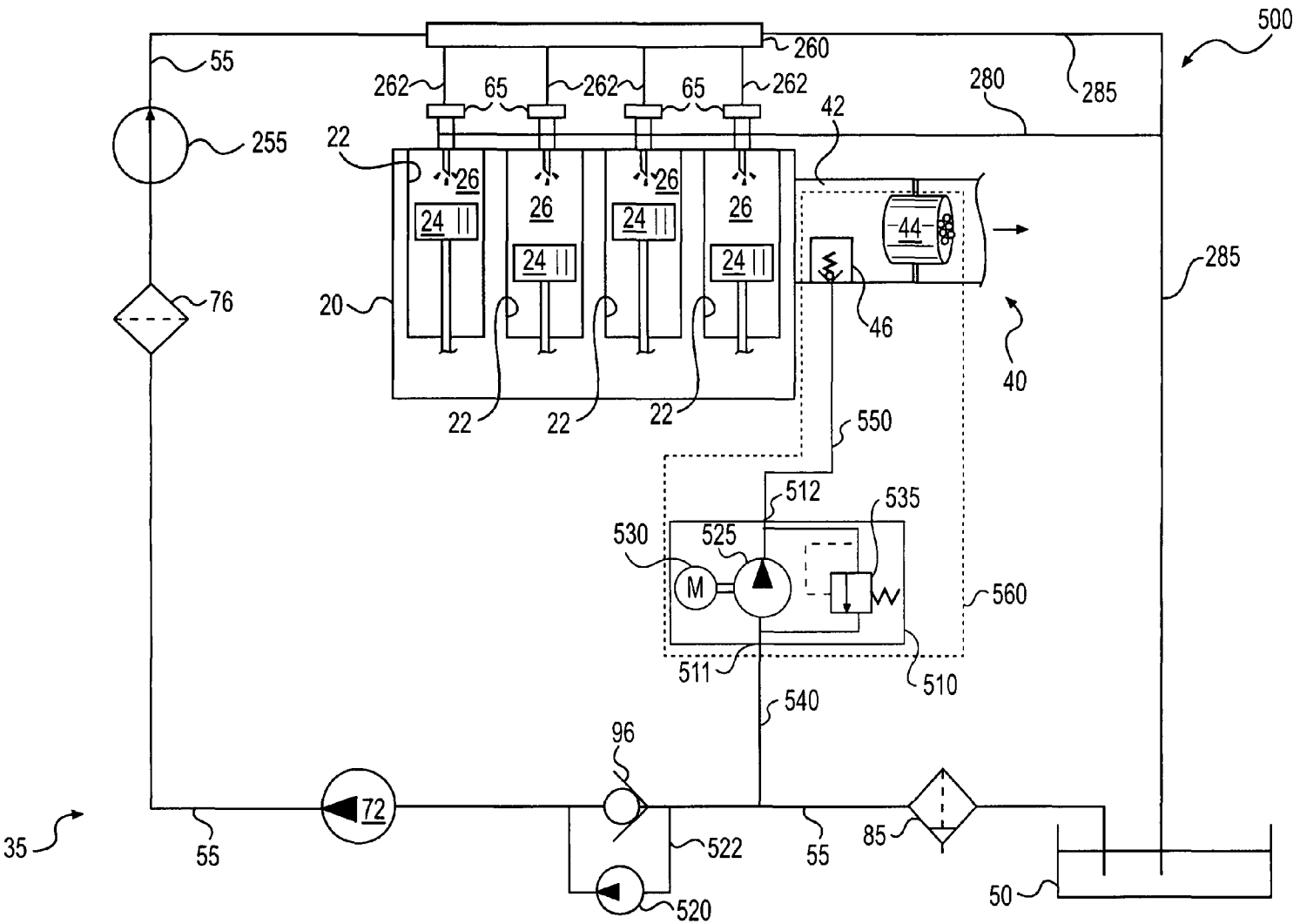
FIG. 6 is a schematic illustration of another exemplary disclosed power system.

In yet another alternative embodiment, as shown in FIG. 6, fuel delivery system 35 of power system 500 may include components similar to those disclosed in FIG. 3, such as high-pressure pump 255, common rail 260, etc.

INDUSTRIAL APPLICABILITY

The fuel delivery system of the present disclosure has wide application in a variety of engine types including, for example, diesel engines, gasoline engines, and gaseous fuel-powered engines. The disclosed fuel delivery system may separately deliver fuel to an engine for combustion through a transfer pump, and for priming and exhaust aftertreatment through an electric pump. In this manner, fuel delivery to the engine for combustion purposes may be substantially unaffected by fuel delivery to the exhaust treatment device, and vice versa. As a result, the disclosed fuel delivery system may provide fuel to multiple systems in an efficient and cost-effective manner.

Referring to FIG. 1, fuel may be drawn from fuel supply 50 and pressurized by transfer pump 72. The pressurized fuel may be directed from transfer pump 72 into combustion engine 20 for combustion purposes. Fuel may also be drawn from fuel supply 50 and pressurized by electric pump 70. The pressurized fuel from electric pump 70 may be selectively directed into combustion engine 20 for priming purposes, and selectively directed into exhaust generated from combustion engine 20 for aftertreatment purposes.

Referring to FIG. 2, during a priming event, electric pump 70 may be driven by electric motor 110 to draw fuel from fuel supply 50 and generate a first fuel flow at a first pressure and a first flow rate. Fuel injection device 46 may be deactivated during the priming event to inhibit fuel injection into the exhaust flow from combustion engine 20. Valve 98 may be opened, manually or electrically by a controller, to allow the first fuel flow to be directed to first outlet 81 through third internal fuel passage 93. The first fuel flow may then be directed from first outlet 81 of electric pump 70 to combustion engine 20. During the priming event, transfer pump 72 may or may not be active.

During an exhaust aftertreatment event, pumping element 105 be driven by electric motor 110 to draw fuel from fuel supply 50 and generate a second fuel flow at a second pressure and a second flow rate. Fuel injection device 46 may be activated to inject fuel into exhaust from combustion engine 20. Valve 98 may be closed to inhibit the second fuel flow being directed through third internal fuel passage 93 to first outlet 81 and subsequently to combustion engine 20. Alternatively, during the exhaust aftertreatment event, valve 98 may be opened to allow a portion of the second fuel flow to be directed to combustion engine 20 through third internal fuel passage 93. It is contemplated that at least one of the second pressure and second flow rate of the second fuel flow directed to exhaust treatment device 44 may be different from the first pressure and the first flow rate directed to combustion engine 20.

Still referring to FIG. 2, when a fuel pressure associated with pumping element 105 or pumping chamber 100 exceeds a predetermined pressure, pressure regulator 99 may be activated to direct a portion of the fuel flow generated by pumping element 105 to a location downstream of valve 98 within third internal fuel passage 93, or to a location downstream of inlet 75 within first internal fuel passage 91.

Referring to FIG. 4, priming may be conducted in an automatic or a manual mode of operation. In the automatic mode of operation, priming may be automatically triggered, for example, by detection of an engine-off event, or by detection of a cranking stage at low speeds. Electric motor 110 (shown in FIG. 2) may be turned on, for example, by the engine control module, to drive pumping element 105 (shown in FIG. 2). Pumping element 105 may generate a fuel flow at a predetermined pressure and flow rate suitable for the priming event. Valve 98 may be opened, for example, by the engine control module, to allow the fuel flow generated by pumping element 105 to be directed to first outlet 81, and subsequently to combustion engine 20. When priming is completed, electric pump 70 may be automatically turned off, for example, by the engine control module.

In the manual mode of operation, when combustion engine 20 is inactive, an operator may manipulate manual switch 330 to turn on the priming function of electric pump 70. Power may be supplied to electric motor 110, for example, through first and/or second power connection ports 310 or 320. Electric motor 110 may drive pumping element 105 to generate a fuel flow at a predetermined pressure and flow rate. Power may also be supplied to valve 98 such that valve 98 may be opened to direct fuel flow from pumping element 105 to combustion engine 20 through third internal fuel passage 93 and first outlet 81. When priming is completed, or at any desired time, the operator may manipulate manual switch 330 to turn off electric pump 70 and thereby terminate the priming event.

Referring to FIG. 5, when exhaust treatment device 44 requires fuel supply, for example, during an exhaust regeneration or aftertreatment event, first electric pump 510 may be turned on to draw fuel from fuel supply 50, pressurize the fuel to generate a fuel flow at a predetermined pressure and flow rate, and direct the pressurized fuel flow to exhaust treatment device 44. Fuel injection device 46 may inject the fuel into exhaust. When fuel is not required by exhaust treatment device 44, first electric pump 510 may be turned off.

Still referring to FIG. 5, during a priming event, second electric pump 520 may be turned on automatically or manually in similar manners discussed above. Second electric pump 520 may draw fuel from fuel supply 50 and generate a fuel flow at a predetermined pressure and flow rate. Second electric pump 520 may direct the pressurized fuel flow to combustion engine 20 through fuel supply line 55 or through a dedicated fuel supply line (not shown). During the priming event, first electric pump 510 may be maintained in an inactive state. When priming is completed, second electric pump 520 may be automatically or manually turned off.

It will be apparent to those skilled in the art that various modifications and variations can be made in the fuel delivery system of the present disclosure without departing from the scope of the disclosure. Other embodiments will be apparent to those skilled in the art from consideration of the specification and practice of the system disclosed herein. It is intended that the specification and examples be considered as exemplary only, with a true scope of the invention being indicated by the following claims and their equivalents.

What is claimed is:

1. A fuel delivery system for a combustion engine having an exhaust treatment device, the fuel delivery system comprising:

a fuel supply;

an injector configured to pressurize fuel and inject the pressurized fuel into the combustion engine;

a transfer pump configured to direct fuel from the fuel supply to the injector; and an electric pump configured to:

selectively direct fuel from the fuel supply to the injector during a priming event; and selectively direct fuel from the fuel supply to the exhaust treatment device.

2. The fuel delivery system of claim 1, wherein the electric pump includes:

a housing;

a pumping chamber located within the housing;

an electric motor; and a pumping element disposed within the pumping chamber and driven by the electric motor to generate a pressurized fuel flow.

3. The fuel delivery system of claim 2, wherein the electric pump further includes a valve movable to allow or inhibit a portion of the pressurized fuel flow to be directed to the combustion engine.

4. The fuel delivery system of claim 3, wherein the electric pump further includes an inlet and a first outlet, the first outlet being configured to direct a portion of the pressurized fuel flow to the combustion engine.

5. The fuel delivery system of claim 4, wherein the electric pump further includes a second outlet configured to direct a portion of the pressurized fuel flow to the exhaust treatment device.

6. The fuel delivery system of claim 4, wherein the electric pump further includes a pressure regulator configured to reduce a pressure associated with the pumping chamber.

7. The fuel delivery system of claim 6, further including a first fuel passage fluidly connecting the inlet and the first outlet, wherein the pressure regulator is configured to direct a portion of the pressurized fuel flow from downstream of the pumping chamber to the first fuel passage.

8. The fuel delivery system of claim 6, further including a second fuel passage, wherein the valve is disposed within the second fuel passage, and the pressure regulator is configured to direct a portion of the pressurized fuel flow from downstream of the pumping chamber to the second fuel passage downstream of the valve.

9. The fuel delivery system of claim 1, further including a filter disposed within the electric pump upstream of the pumping chamber.

10. The fuel delivery system of claim 1, further including a fuel passage fluidly connecting the inlet and the first outlet and a valve disposed within the fuel passage.

11. A fuel delivery system for a combustion engine having an exhaust treatment device, comprising:

a fuel supply;

a common rail;

a high-pressure pump configured to pressurize fuel directed to the common rail;

an injector configured to inject pressurized fuel from the common rail into the combustion engine;

a fuel transfer pump configured to direct fuel from the fuel supply to the high-pressure pump; and an electric pump configured to:

selectively direct fuel from the fuel supply to the combustion engine during a priming event; and selectively direct fuel from the fuel supply to the exhaust treatment device.

12. The fuel delivery system of claim 11, wherein the electric pump includes:

a housing;

a pumping chamber located within the housing;

an electric motor; and a pumping element disposed within the pumping chamber driven by the electric motor to generate a pressurized fuel flow.

13. The fuel delivery system of claim 12, wherein the electric pump further includes a valve movable to allow or inhibit a portion of the pressurized fuel flow directed to the combustion engine.

14. The fuel delivery system of claim 12, wherein the electric pump further includes:

an inlet;

a first outlet configured to direct a portion of the pressurized fuel flow to the combustion engine; and a second outlet configured to direct a portion of the pressurized fuel flow to the exhaust treatment device.

15. The fuel delivery system of claim 14, wherein the electric pump further includes a pressure regulator associated with the pumping chamber and being configured to reduce a pressure associated with the pumping chamber.

16. The fuel delivery system of claim 15, further including a first fuel passage fluidly connecting the inlet and the first outlet, wherein the pressure regulator is configured to direct a portion of the pressurized fuel flow from downstream of the pumping chamber to the first fuel passage.

17. The fuel delivery system of claim 11, further including a fuel passage fluidly connecting the inlet and the first outlet and a valve disposed within the fuel passage.

18. A method of providing fuel to a power system including a combustion engine, the method comprising:

transferring fuel from a supply to a first location;

pressurizing fuel at the first location;

directing the from the first location into the combustion engine during normal operation of the combustion engine;

pressurizing fuel at a second location;

selectively directing fuel from the second location into the combustion engine during a priming event; and selectively directing fuel from the second location into exhaust from the combustion engine.

* * * * *